US006910930B1

(12) United States Patent
Mitchell

(10) Patent No.: US 6,910,930 B1
(45) Date of Patent: Jun. 28, 2005

(54) EXHAUST DIVERTER NOZZLE

(76) Inventor: Neal Mitchell, 2866 Walnut St., Ontario, CA (US) 91761

( * ) Notice: Subject to any disclaimer, the term of this patent is extended or adjusted under 35 U.S.C. 154(b) by 10 days.

(21) Appl. No.: 10/746,717

(22) Filed: Dec. 29, 2003

(51) Int. Cl.[7] ..... B63H 21/32
(52) U.S. Cl. ..... 440/89 R
(58) Field of Search ..... 440/89 R, 89 B, 440/89 C, 88 R, 88 G, 88 J

(56) References Cited

U.S. PATENT DOCUMENTS 6,035,633 A * 3/2000 Woods ..... 60/310
6,554,664 B1 * 4/2003 Nanami ..... 440/88 J
6,663,451 B1 * 12/2003 Walczak ..... 440/89 R

* cited by examiner

*Primary Examiner*—Jesus D. Sotelo
(74) *Attorney, Agent, or Firm*—Neil John Graham

(57) ABSTRACT

An exhaust diverter nozzle used in seawater cooling of the exhaust of marine engines, particularly diesel, without added back pressure the nozzle diverts the seawater in the exhaust at low engine rpm (1600–2000 rpm) in a manner which greatly enhances the vaporization of the water producing an evaporative cooling which extends the life of the exhaust tubes.

19 Claims, 2 Drawing Sheets

EXHAUST DIVERTER NOZZLE

FIELD OF INVENTION

The present invention is directed to an exhaust diverter nozzle used in water cooling the exhaust of marine engines. The exhaust diverter nozzle diverts the exhaust cooling water in a manner which greatly enhances the vaporization of the water, thus cooling, at low engine rpm of 1600–2000 rpm.

BACKGROUND OF THE INVENTION

Inboard marine engines require exhaust systems to carry the hot exhaust to the exterior of the boat. Engines, especially diesel engines, generate a considerable amount of heat which is dissipated through the exhaust. The heat becomes a problem because the exhaust system is contained within the hull of the boat. Exhaust elbows are mounted to the exhaust manifold of the engine wherein seawater is added to the exhaust. The water channel usually externally jackets the circular exhaust pipe and mixes with the exhaust gas with a cooling effect. The more the water is atomized and vaporized the cooler the exhaust becomes. The cooling effect of vaporized water is best demonstrated in evaporative coolers which have existed since 1937. The exhaust elbow cooling system is most effective at high engine speeds wherein large volumes of seawater flow through the exhaust. Cooling the exhaust lines at low engine rpm speeds (1600–2000 rpm) is a problem because of the low volume of water. With low seawater flow through the exhaust elbow the seawater only flows through in the lower part of the exhaust elbow which produces very little atomization and vaporization of the water which is necessary for the vaporization cooling effect. The exhaust heat at low engine speeds has caused early deterioration of the silicone-acrylic exhaust tubes which are used more commonly with diesel engines. This is particularly evident in the wet exhaust system of the Nordhavn 35 coastal pilot which is designed to maximize working space of the engine room. The 5" rubber exhaust hose is routed to the water lift box mounted in the Lazarett. The exhaust hose has a history of damage at low engine rpm (1600–2000 rpm), the reduced water flow through the exhaust elbow does not provide a water spray pattern for sufficient heat exchange of the exhaust gases.

In order to overcome the overheating problems water has been injected at the upper part of the water jacket. In U.S. Pat. No. 6,293,121 atomizer nozzles are used to maximize the water surface. Both methods have limited success and longevity, the heat of the exhaust and corrosiveness of the seawater combine to close the water orifices.

SUMMARY OF THE INVENTION

The present invention is directed to an exhaust diverter nozzle for atomizing cooling seawater in exhaust systems of marine engines run at low rpm (1600–2000 rpm). Atomization of the seawater enhances evaporation of the seawater which greatly enhances the cooling of the exhaust tubes which are frequently composed of a rubber (silicone) material which cannot withstand high heat. Silicone melts at 350° F. The exhaust diverter nozzle is comprised of a configured circular tube of sufficient diameter to be fitted within an exhaust hose. Exhaust hoses come in diameters of 3"–12", varying according to the size and application of the marine engine. Exhaust hoses 5" in diameter are commonly used in the Nordhavn 35 Coastal Pilot. The 5" diameter exhaust diverter nozzle is comprised of a 5" circular tube with an inlet and an outlet and a longitudinal length of 5", a lip at the outlet, and two longitudinal diverters. The two longitudinal diverters are 2–5 mm thick and 2" wide and are attached to the internal of the circular tube extending longitudinally from the inlet to the outlet. The diverters are mounted with their 2" width at a right angle to the internal surface of the circular tube. The diverters are mounted parallel adjacent to each other at the lower part of the tube inlet. Each diverter travels longitudinally climbing each internal side while remaining at a right angle to the internal tube surface until reaching the tube outlet at the 90 position. At the tube outlet each diverter is on a horizontal plane. The outlet of the circular tube has a circumferential 45 degree lip extending at least ⅜" inwards towards the axial center of the tube outlet.

The exhaust diverter nozzle is inserted within the rubber exhaust tube adjacent to the exhaust elbow outlet. The exhaust tube is often composed of two layers of silicone with a layer of fiberglass between them. The exhaust diverter nozzle is mounted with the diverters at the lower part of the tube inlet. At low engine rpm (1600–2000 rpm) seawater only trickles at the lower portion of the exhaust tube. The function the diverters is to direct part of the water towards the upper part of the tube outlet where the water hits the 45 lip and is directed inwards to form an atomized water column. The exhaust hits the atomized water column and the heat of the exhaust gas vaporizes the water into gas which produces a cooling effect similar to that of an evaporative cooler. The conversion of liquid to gas requires heat which is drawn from the environment. The exhaust gas temperature measured following the exhaust diverter nozzle measures 120° F. when a marine diesel engine is run 1600–2000 rpm. Without the exhaust diverter nozzle the measured temperature is 250° F.

The composition of the exhaust diverter nozzle in a preferred embodiment is a metal alloy containing titanium which is highly resistant to heat and corrosion from seawater. Any soldering or welding materials should contain titanium. In another embodiment the exhaust diverter nozzle may be comprised of other materials, such as ceramics, which have the qualities of resistance to heat and seawater corrosion.

DETAILED DESCRIPTION OF THE INVENTION

Figure 1:
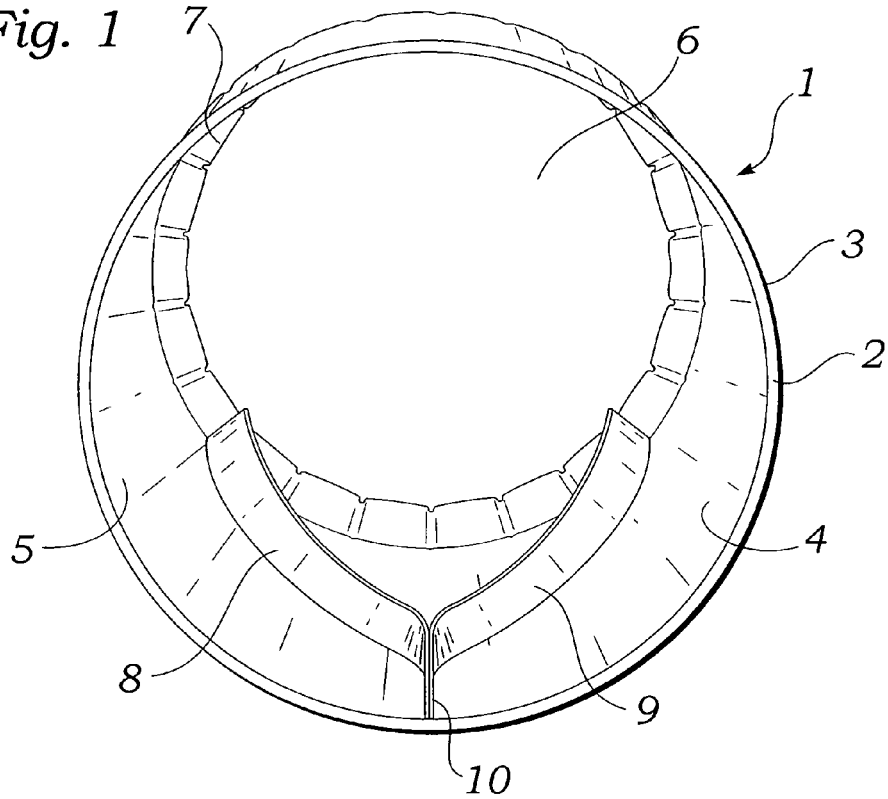
FIG. 1 is an inlet end view of the exhaust diverter nozzle.
Figure 2:
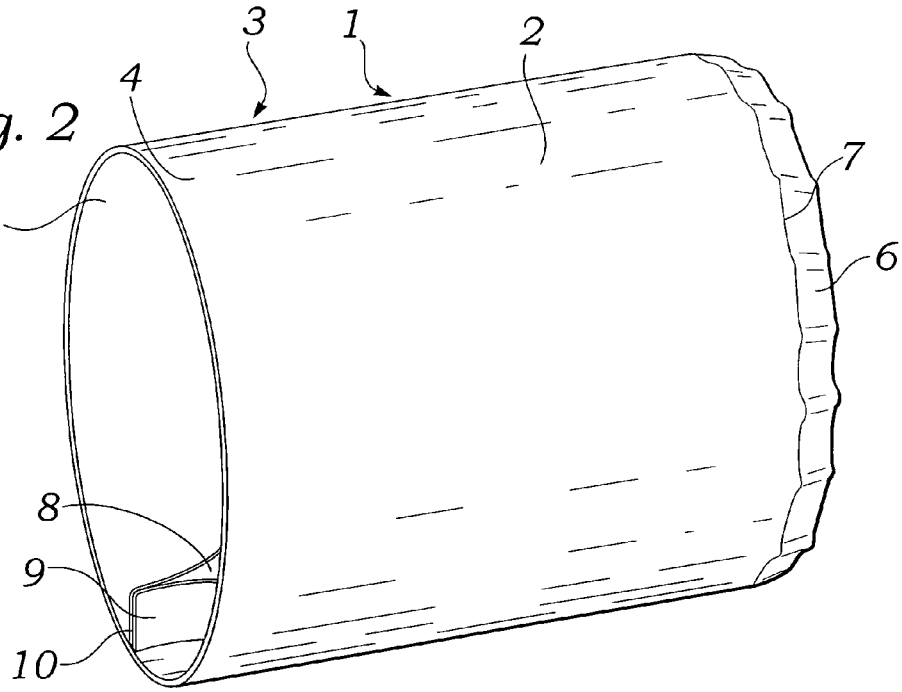
FIG. 2 is a side view of the exhaust diverter nozzle.
Figure 3:
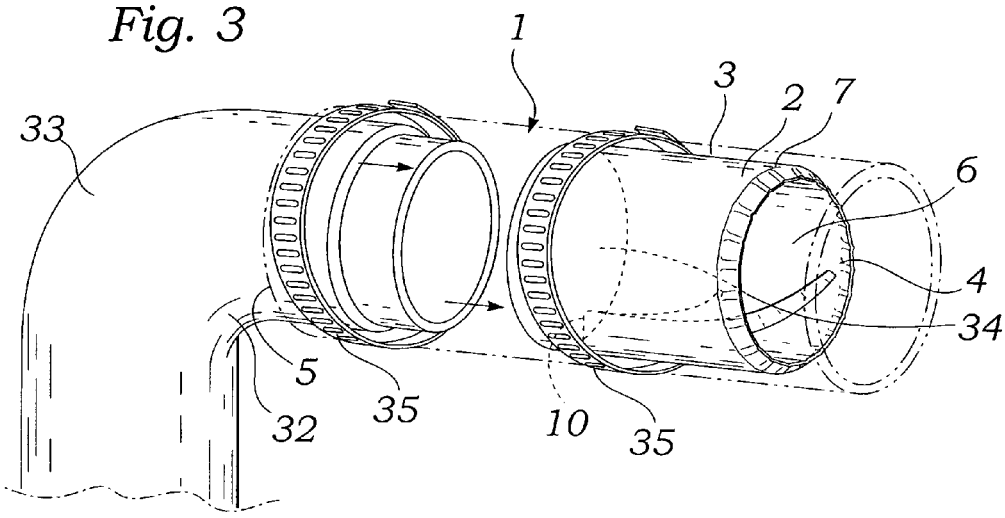
FIG. 3 is a side view of an exhaust diverter nozzle connected to an exhaust tube with an exhaust diverter nozzle fitted internally.
Figure 4:
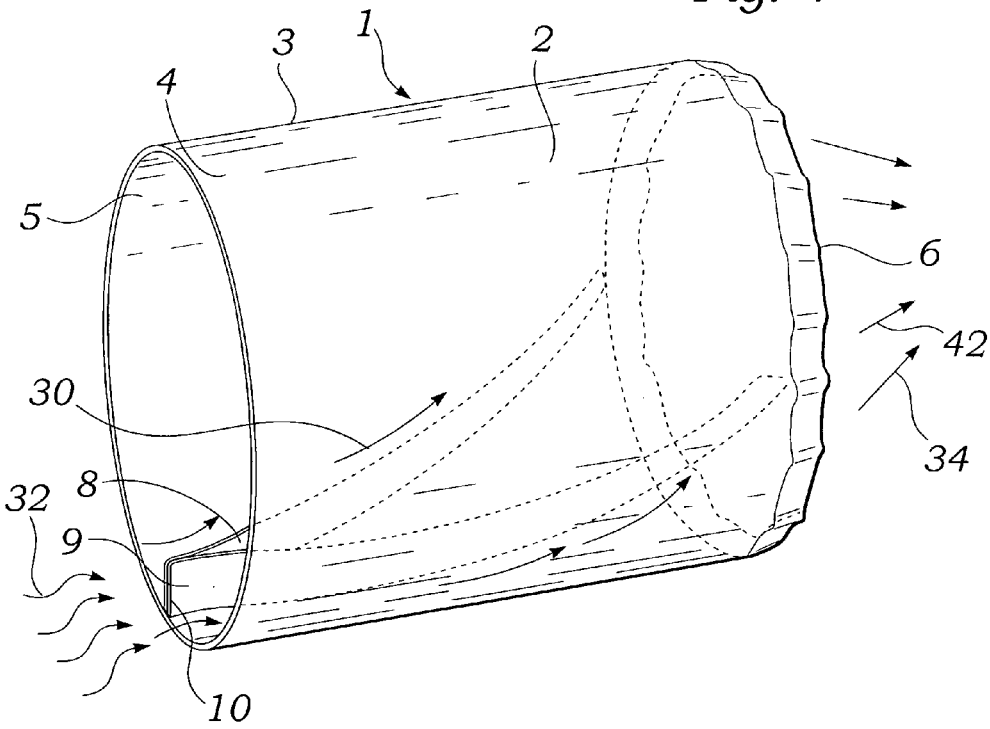
FIG. 4 is a side view of the invention with seawater flow.

Referring to FIGS. 1–4 the exhaust diverter nozzle 1 has a tubular longitudinal body 2 with an external 3, and internal 4, an open inlet end 5 and an open outlet end 6. The external diameter 3 of the tubular longitudinal body 2 should be sufficient to fit within a marine exhaust tube 31 as shown in FIGS. 3 and 4. The marine exhaust tubes 31 come in diameters of 3"–12", 5" being the most common, but vary according to use. In a preferred embodiment tubular longitudinal body 2 has a 5" diameter with a minimum length of 5". The open outlet end 6 of the tubular longitudinal body 2 has a 45° lip 7 extending inwards and away from the tubular longitudinal body 2. The lip 7 must have a minimal width of ⅜". In FIGS. 1 and 2 extending inwards at a right angle from the internal surface 4 of the tubular longitudinal body 2 are left 8 and right 9 longitudinal diverters 8 and 9. The diverters 8 and 9 are 24 mm wide and 2" minimum in height. In FIGS. 1, 2 and 3 the left 8 and right 9 diverters are adjacent and parallel to each other at the lower portion 10 of the inlet 5. The left 8 and right 9 diverters extend longitudinally in the internal 4 of the longitudinal body 2, each diverter 8 and 9 remaining 90° to the internal surface 4 as they climb upwards 90° as they reach the outlet end 6 of the tube 2.

In FIGS. 1, 2 and 3 the outlet end 6 extends inwards 45° to the long axis of the tubular longitudinal body 2 a minimum of ⅜". FIG. 3 shows a marine exhaust elbow 33 which functions by mixing sea water with exhaust gas. FIG. 3 shows a common exhaust elbow 33 where the water channel 32 encircles the exhaust 34. The seawater 32 mixes with the exhaust 34 where the exhaust tube 31 attaches to the exhaust elbow 33. The exhaust diverter nozzle 1 is located within the interior of the exhaust tube 31 adjacent to the exhaust elbow 33. A hose clamp 35 is attached external to the exhaust tube 2 which holds the exhaust diverter nozzle 1 in place. In FIG. 4 at low engine rpm speeds (1600–2000 rpm) the seawater, due to the lack of volume of water flow, is mainly in the lower portion of the seawater channel 32. The right and left diverters 8 and 9 direct the seawater 40 upwards towards the tube outlet 6 wherein the water 40 is uniformly distributed around the entire outlet 6. The seawater 42 then strikes the 45° lip 7 which directs the seawater 42 inwards in a conical sheet 41 which atomizes the water 42. The exhaust 34 then hits the atomized water 42 which vaporizes the water 42 resulting in evaporative cooling of the exhaust.

The sizes of the parts of the exhaust diverter nozzle vary proportionate to the varying diameters required to fit the variety of exhaust hose diameters.

The composition of the exhaust diverter nozzle 1 may be a variety of alloys or ceramic. The requirement of the composition is to withstand vibration, exhaust heat, and corrosion by the seawater. The material of choice contains titanium. The diverters may be constructed integral with the tubular longitudinal body 2 or attached to the tubular longitudinal body 2 by electro welding or soldering. The solder of choice contains titanium.

What is claimed:

1. An exhaust diverter nozzle for atomizing seawater during the running of marine engines at low rpm comprising:

a tubular longitudinal body with an axial diameter, an inlet first end, an outlet second end, an interior surface with left and right side walls, an exterior, and a top and bottom when the exhaust diverter nozzle is mounted longitudinally horizontal in a marine engine exhaust;

diverters which direct seawater upwards; and a lip at the tubular longitudinal outlet directing the seawater inwards towards the axial center.

2. An exhaust diverter nozzle as in claim 1 wherein there are two diverters, each 1–5 mm thick and a minimum of 2" wide, wherein the two diverters start adjacent to each other at the inlet, the width at a right angle to the inner surface of tubular longitudinal body and remaining 90 degrees to the tubular longitudinal body inner surface as the diverters longitudinally ascend the respective side walls ending 90 degrees up the side walls at the outlet end of the tubular longitudinal body.

3. An exhaust diverter nozzle as in claim 1 wherein the exterior of the tubular body fits the inner diameter of an exhaust tube.

4. An exhaust diverter nozzle as in claim 1 wherein the lip extends a minimum of ⅜ in. towards the tubular body axial center.

5. An exhaust diverter nozzle as in claim 1 wherein the tubular longitudinal body is 5" in diameter and 5" in length.

6. An exhaust diverter nozzle as in claim 1 wherein the exhaust diverter nozzle is composed of metal.

7. An exhaust diverter nozzle as in claim 6 wherein the exhaust diverter nozzle is a metal alloy.

8. An exhaust diverter nozzle as in claim 1 wherein the exhaust diverter nozzle is an alloy of metals including titanium.

9. An exhaust diverter nozzle as in claim 1 wherein the exhaust diverter nozzle composition is ceramic.

10. An exhaust diverter nozzle for atomizing seawater during the running of marine engines at low rpm comprising:

a tubular longitudinal body with an axial diameter, an inlet first end, an outlet second end, an interior surface with left and right side walls, an exterior, and a top and bottom when the exhaust diverter nozzle is mounted longitudinally horizontally in a marine engine exhaust;

diverters which direct seawater upwards;

a lip at the tubular longitudinal outlet directing the seawater inwards towards the axial center; and a hose clamp clamped over the marine exhaust to secure the exhaust diverter nozzle within the marine exhaust.

11. An exhaust diverter nozzle as in claim 10 wherein there are two diverters, each 1–5 mm thick and a minimum of 2" wide, wherein the two diverters start adjacent to each other at the inlet, the width at a right angle to the inner surface of tubular longitudinal body and remaining 90° to the tubular longitudinal body inner surface as the diverters longitudinally ascend the respective side walls ending 90° up the side walls at the outlet end of the tubular longitudinal body.

12. An exhaust diverter nozzle as in claim 10 wherein the exterior of the tubular body fits the internal of an exhaust tube.

13. An exhaust diverter nozzle as in claim 10 wherein the lip extends a minimum of ⅜".

14. An exhaust diverter nozzle as in claim 10 wherein the tubular longitudinal body is 5" in diameter and 5" in length.

15. An exhaust diverter nozzle as in claim 10 wherein the composition of the exhaust diverter nozzle is metal.

16. An exhaust diverter nozzle as in claim 15 wherein the exhaust diverter nozzle is a metal alloy.

17. An exhaust diverter nozzle as in claim 10 wherein the composition of the exhaust diverter nozzle is a metal alloy including titanium.

18. An exhaust diverter nozzle as in claim 10 wherein the exhaust diverter nozzle is composed of ceramic.

19. The process of vaporizing water in the exhaust system of a marine engine comprised of:

placing an exhaust diverter nozzle with an internal, external, inlet, outlet, internal seawater diverters and a lip located at the outlet within an exhaust line adjacent to a marine exhaust elbow;

diverting seawater upwards as the seawater enters the lower portion of the exhaust diverter nozzle;

sheeting the seawater inwards as it strikes the lip;

atomizing the water as it forms a cone after striking the lip;

vaporizing the water as the exhaust gas strikes the atomized water; and cooling the exhaust gas by the heat absorbing process of water vaporization.

* * * * *